US008434903B2

(12) United States Patent
Chen

(10) Patent No.: US 8,434,903 B2
(45) Date of Patent: May 7, 2013

(54) LIGHTING DEVICE

(75) Inventor: Tien-Pao Chen, New Taipei (TW)

(73) Assignee: Asia Vital Components Co. Ltd., New Taipei (TW)

( * ) Notice: Subject to any disclaimer, the term of this patent is extended or adjusted under 35 U.S.C. 154(b) by 0 days.

(21) Appl. No.: 13/211,503

(22) Filed: Aug. 17, 2011

(65) Prior Publication Data

US 2013/0044471 A1 Feb. 21, 2013

(51) Int. Cl.
*F21V 33/00* (2006.01)

(52) U.S. Cl.
USPC ..... 362/254; 362/249.02; 362/249.06; 362/219

(58) Field of Classification Search ..... 362/249.02, 362/249.06, 254, 219
See application file for complete search history.

(56) References Cited

U.S. PATENT DOCUMENTS

| | | | | |
|---|---|---|---|---|
| 5,688,042 | A * | 11/1997 | Madadi et al. | 362/240 |
| 7,798,685 | B2 * | 9/2010 | Edmond et al. | 362/473 |
| 2007/0133202 | A1 * | 6/2007 | Huang et al. | 362/235 |
| 2008/0180962 | A1 * | 7/2008 | Edmond et al. | 362/473 |
| 2009/0135595 | A1 * | 5/2009 | Chen | 362/235 |
| 2010/0284188 | A1 * | 11/2010 | Chen et al. | 362/249.02 |

* cited by examiner

*Primary Examiner* — Laura Tso

(57) ABSTRACT

A lighting device includes a tubular body and a substrate. The tubular body has a chamber, a first end and a second end. The first and second ends communicate with the chamber. The substrate is axially disposed in the chamber. Multiple light-emitting elements are arranged on the substrate. By means of the substrate, the projection range and projection angle of the lighting device are enlarged to enhance luminous efficiency of the lighting device.

5 Claims, 5 Drawing Sheets

LIGHTING DEVICE

BACKGROUND OF THE INVENTION

1. Field of the Invention

The present invention relates generally to a lighting device with larger projection angle and projection range.

2. Description of the Related Art

There is a trend toward energy saving and carbon reduction in the field of lighting equipments. Accordingly, the conventional tungsten filament bulbs have been gradually replaced with light-emitting diodes for saving power.

The light-emitting diode has the advantage of energy saving. However, the projection angle of the light emitted from the light-emitting diode is relatively small. This is because the lighting angle of the light-emitting diode is simply about 120 degrees due to its own luminous properties. Therefore, in the case that the light-emitting diode is assembled with a light tube without property of diffusion, the lighting angle of the light-emitting diode can be hardly enlarged.

In many application situations, clients desire that the luminous properties of the light-emitting diode lamp tube are as similar to the luminous properties of the conventional fluorescent lamp tube as possible. Therefore, most of the light-emitting diode lamp tubes are made of materials with diffusion effect. In this case, on one hand, the luminous properties of the light-emitting diode lamp tube are more similar to the luminous properties of the conventional fluorescent lamp tube and on the other hand, the glare of the lighting device can be minimized.

In general, even if a diffusion agent is added, in comparison with the conventional lamp tube, the lighting angle of the light-emitting diode is still narrower. The ratio of the diffusion agent can be increased to achieve larger lighting angle. However, under such circumstance, the permeability will be greatly decreased. Accordingly, the conventional lighting device has the following shortcomings:

1. Smaller projection angle.
2. Poor permeability.
3. Smaller projection range.

SUMMARY OF THE INVENTION

A primary object of the present invention is to provide a lighting device with larger projection angle and projection range.

To achieve the above and other objects, the lighting device of the present invention includes a tubular body and a substrate.

The tubular body has a chamber, a first end and a second end. The first and second ends communicate with the chamber.

The substrate is axially disposed in the chamber. Multiple light-emitting elements are arranged on the substrate. By means of changing the configuration of the substrate, the positions of the light-emitting elements arranged in the tubular body can be changed. Accordingly, the light-emitting elements can be arranged in different angular positions rather than on a plane as in the conventional lighting device. Therefore, the projection angle of the lighting device can be enlarged to enhance illumination of the lighting device without using any additional optical component.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
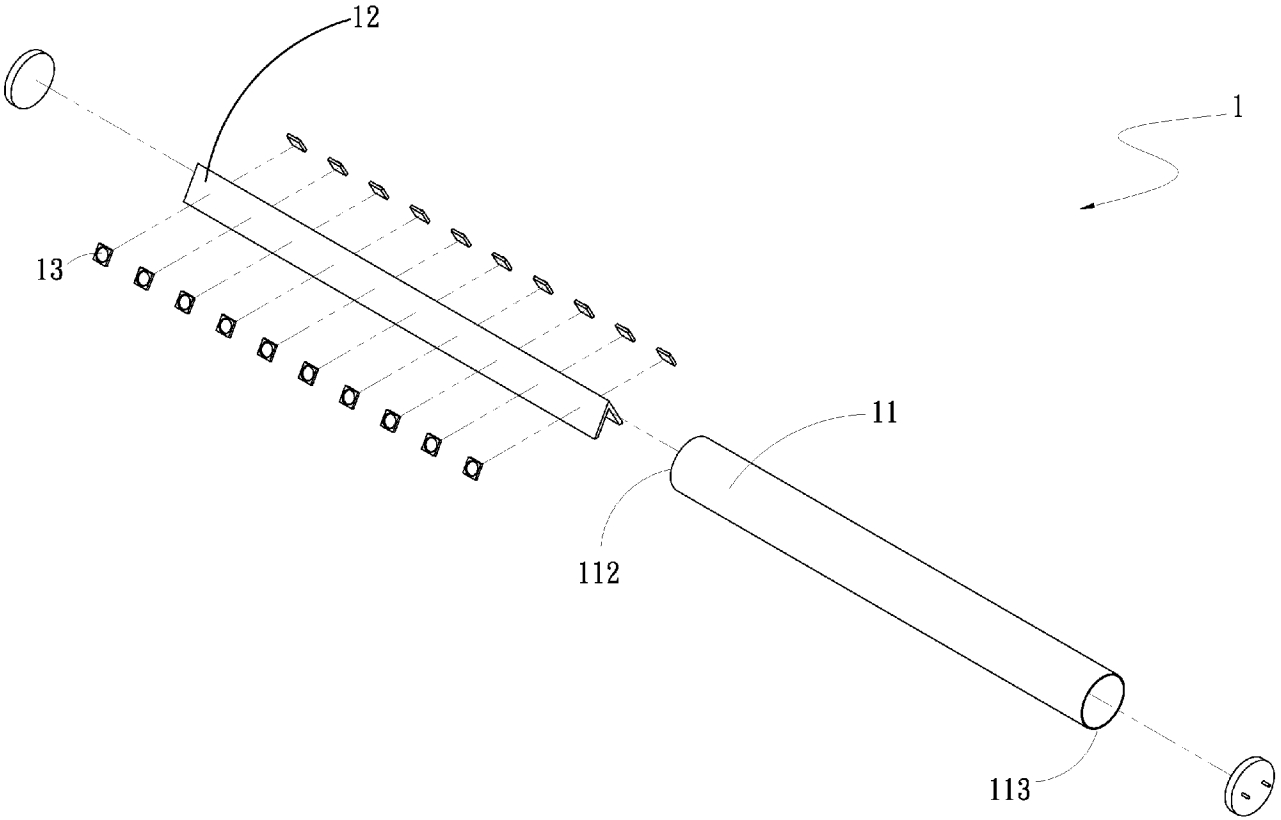
FIG. 1 is a perspective exploded view of a first embodiment of the lighting device of the present invention.
Figure 2:
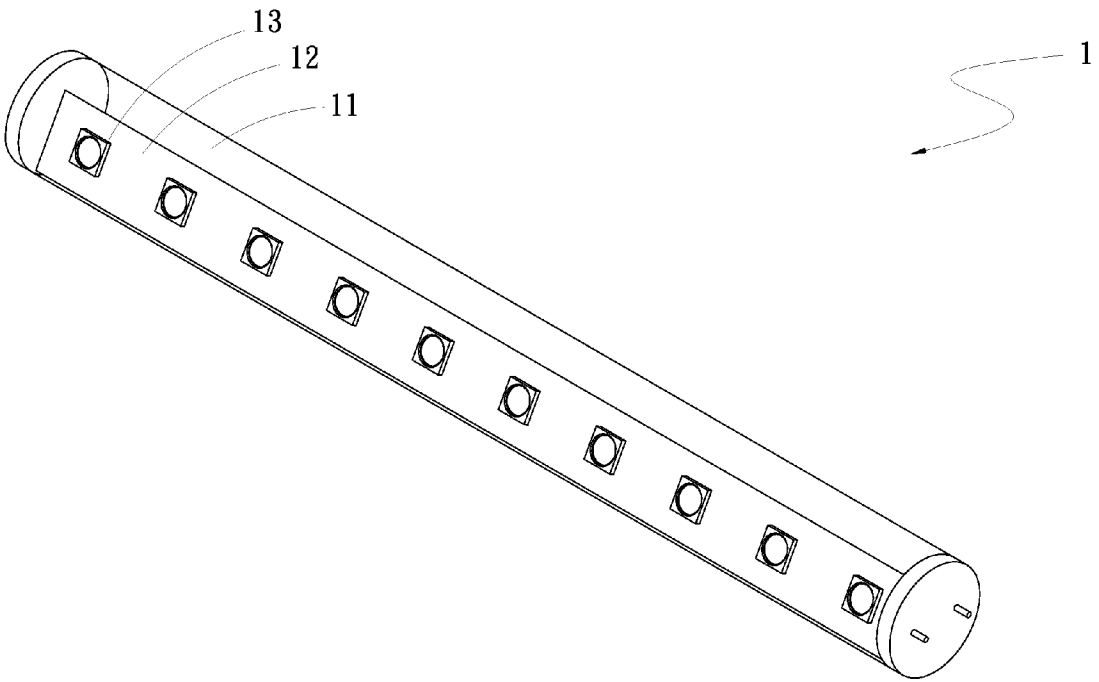
FIG. 2 is a perspective assembled view of the first embodiment of the lighting device of the present invention.
Figure 3:
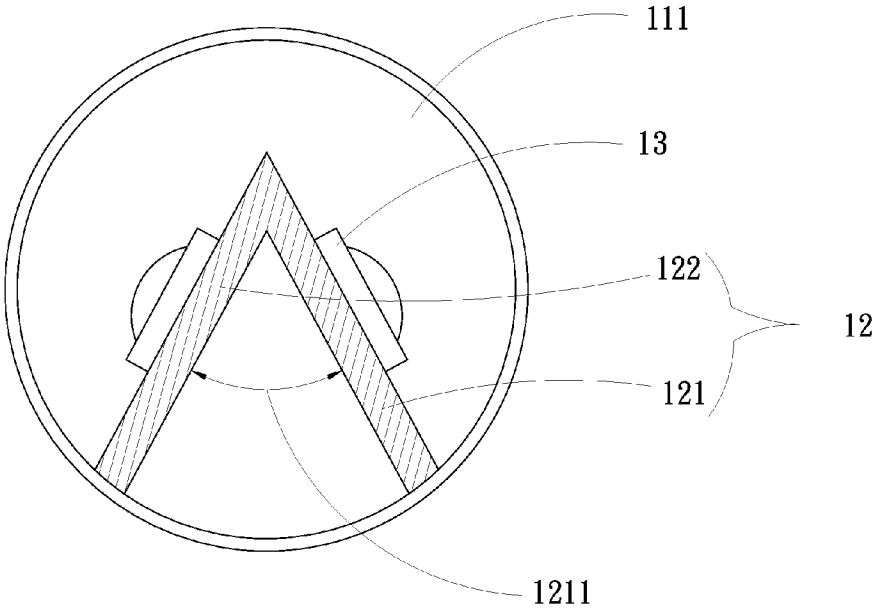
FIG. 3 is a sectional view of the first embodiment of the lighting device of the present invention.

Please refer to FIGS. 1, 2 and 3. FIG. 1 is a perspective exploded view of a first embodiment of the lighting device of the present invention. FIG. 2 is a perspective assembled view of the first embodiment of the lighting device of the present invention. FIG. 3 is a sectional view of the first embodiment of the lighting device of the present invention. According to the first embodiment, the lighting device 1 of the present invention includes a tubular body 11 and a substrate 12.

The tubular body 11 has a chamber 111, a first end 112 and a second end 113. The first and second ends 112, 113 communicate with the chamber 111.

The substrate 12 is axially disposed in the chamber 111. Multiple light-emitting elements 13 are arranged on the substrate 12.

The light-emitting elements 13 are light-emitting diodes arranged on one side of the substrate 12.

The substrate 12 has a first extension section 121 and a second extension section 122. One end of the first extension section 121 is connected with the second extension section 122, whereby the first and second extension sections 121, 122 contain a first angle 1211. The light-emitting elements 13 are arranged on the first and second extension sections 121, 122. The substrate 12 has a reverse V-shaped cross section.

The light-emitting elements 13 are respectively arranged on one side of the first and second extension sections 121, 122 to project light outward from the chamber 111.

The configuration of the substrate 12 is variable to directly change the projection range of the lighting device 1 and the projection angle of the light-emitting elements 13. Accordingly, the projection range and angle can be enlarged without using any additional cooperative optical component.

Figure 4:
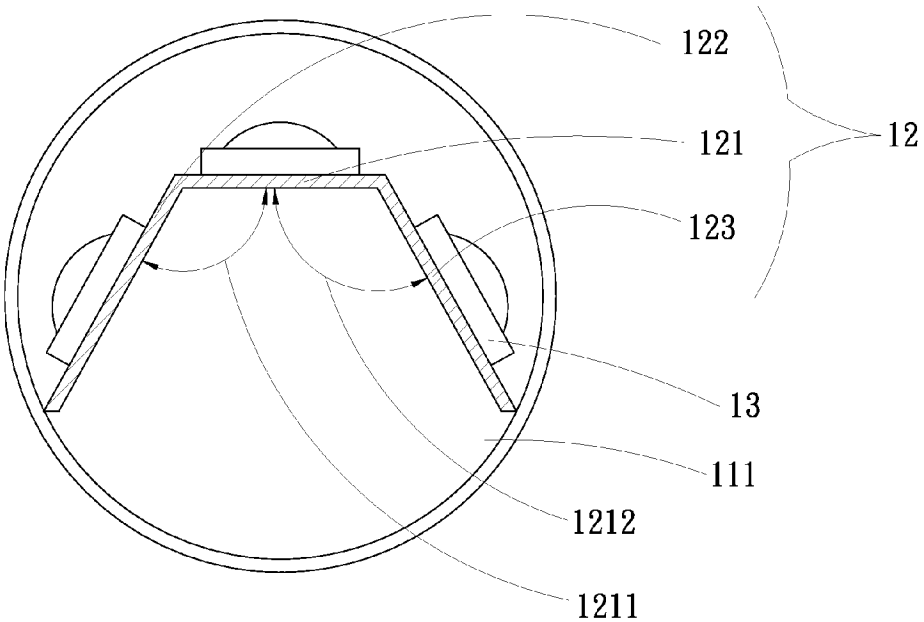
FIG. 4 is a sectional view of a second embodiment of the lighting device of the present invention.

Please refer to FIG. 4, which is a sectional view of a second embodiment of the lighting device of the present invention. The second embodiment is substantially identical to the first embodiment in structure and connection relationship between the components and thus will not be repeatedly described hereinafter. The second embodiment is mainly different from the first embodiment in that the substrate 12 has a first extension section 121, a second extension section 122 and a third extension section 123. Two ends of the first extension section 121 are respectively connected with the second and third extension sections 122, 123. The first and second extension sections 121, 122 contain a first angle 1211, while the first and third extension sections 121, 123 contain a second angle 1212. The light-emitting elements 13 are arranged on the first, second and third extension sections 121, 122, 123. The substrate 12 has a trapezoidal cross section.

The light-emitting elements 13 are respectively arranged on one side of the first, second and third extension sections 121, 122, 123 to project light outward from the chamber 111.

Figure 5:
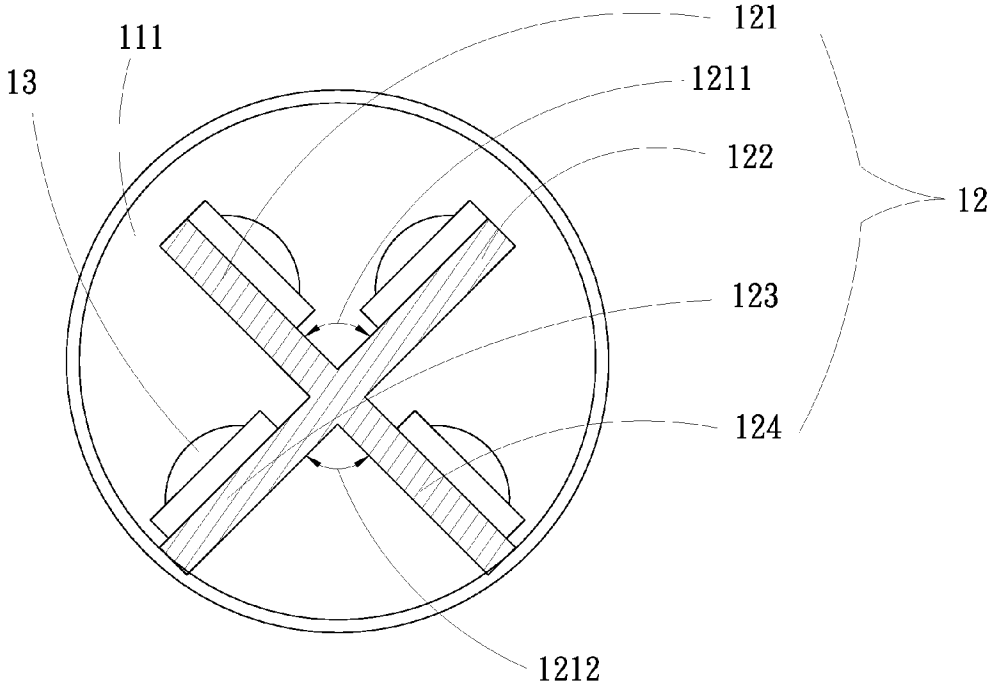
FIG. 5 is a sectional view of a third embodiment of the lighting device of the present invention.

Please refer to FIG. 5, which is a sectional view of a third embodiment of the lighting device of the present invention. The third embodiment is substantially identical to the first embodiment in structure and connection relationship between the components and thus will not be repeatedly described hereinafter. The third embodiment is mainly different from the first embodiment in that the substrate 12 has a first extension section 121, a second extension section 122, a third extension section 123 and a fourth extension section 124. One end of the first extension section 121 is connected with the second extension section 122. The first and second extension sections 121, 122 contain a first angle 1211. The light-emitting elements 13 are arranged on the first and second extension sections 121, 122. One end of the third extension section 123 is connected with the fourth extension section 124. The third and fourth extension sections 123, 124 contain a second angle 1212. The light-emitting elements 13 are arranged on the third and fourth extension sections 123, 124. The substrate 12 has an X-shaped cross section.

The light-emitting elements 13 are respectively arranged on one side of the first, second, third and fourth extension sections 121, 122, 123, 124 to project light outward from the chamber 111.

In the above embodiments, the tubular body 11 can be a transparent or semitransparent tubular body.

According to the above arrangement, the projection angle and range of the lighting device 1 can be enlarged without using any additional cooperative optical component. This eliminates the shortcoming of insufficient projection angle and range that exists in the conventional lighting device.

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. A lighting device comprising:

a tubular body having a chamber, a first end and a second end, the first and second ends communicating with the chamber;

a substrate axially disposed in the chamber, multiple light-emitting elements being arranged on the substrate; and wherein the substrate has a first extension section, a second extension section, a third extension section and a fourth extension section, one end of the first extension section being connected with the second extension section, the first and second extension sections containing a first angle, the light-emitting elements being arranged on the first and second extension sections, one end of the third extension section being connected with the fourth extension section, the third and fourth extension sections containing a second angle, the light-emitting elements being arranged on the third and fourth extension sections, the substrate having an X-shaped cross section.

2. The lighting device as claimed in claim 1, wherein the light-emitting elements comprise light-emitting diodes arranged on one side of the substrate.

3. The lighting device as claimed in claim 1, wherein the light-emitting elements comprise light-emitting diodes respectively arranged on one side of the first, second and third extension sections.

4. The lighting device as claimed in claim 1, wherein the light-emitting elements are light-emitting diodes respectively arranged on one side of the first, second, third and fourth extension sections.

5. The lighting device as claimed in claim 1, wherein the tubular body is a transparent or semitransparent tubular body.

* * * * *